US012520891B2

(12) United States Patent
Justice et al.

(10) Patent No.: US 12,520,891 B2
(45) Date of Patent: Jan. 13, 2026

(54) MEDICAL GOWN AND METHOD OF DONNING THE SAME

(71) Applicant: DEPRE, LLC, Powell, TN (US)

(72) Inventors: Mark Edward Justice, Powell, TN (US); Sam Griffin, New Tazewell, TN (US); Todd Max Cupp, New Tazewell, TN (US); William Todd Klempnauer, Arlington, TX (US); Christopher Joseph Schulze, Knoxville, TN (US); Ethan Edward Valentine, Knoxville, TN (US); Robert E. Andrews, Falmouth, ME (US); Samuel E. Darcy, Cleveland, WI (US); Scott A. Roehrborn, Sheboygan, WI (US); Jeffrey W. Fritz, Plymouth, WI (US)

(73) Assignee: DePre, LLC, Powell, TN (US)

( * ) Notice: Subject to any disclaimer, the term of this patent is extended or adjusted under 35 U.S.C. 154(b) by 44 days.

(21) Appl. No.: 18/563,771

(22) PCT Filed: May 17, 2022

(86) PCT No.: PCT/US2022/029623
§ 371 (c)(1),
(2) Date: Nov. 22, 2023

(87) PCT Pub. No.: WO2022/251005
PCT Pub. Date: Dec. 1, 2022

(65) Prior Publication Data

US 2024/0245152 A1 Jul. 25, 2024

Related U.S. Application Data

(60) Provisional application No. 63/194,079, filed on May 27, 2021.

(51) Int. Cl.
*A41D 13/12* (2006.01)

(52) U.S. Cl.
CPC ..... *A41D 13/1245* (2013.01); *A41D 13/1209* (2013.01); *A41D 13/129* (2013.01); *A41D 2300/33* (2013.01); *A41D 2400/52* (2013.01)

(58) Field of Classification Search
CPC ..... A41D 13/1236; A41D 13/1245; A41D 13/1254; A41D 13/1263; A41D 13/129; A41D 13/1209; A41D 13/12
See application file for complete search history.

(56) References Cited

U.S. PATENT DOCUMENTS 1,930,212 A * 10/1933 Pureell ..... A41D 13/1245 2/92
1,998,051 A * 4/1935 Gerber ..... A41D 13/1236 2/114

(Continued)

FOREIGN PATENT DOCUMENTS

JP 2014-84541 5/2014
JP 3228389 10/2020

(Continued)

OTHER PUBLICATIONS

Saudi Authority for Intellectual Property, Notice of Substantive Examination Report (in Arabic) issued on Saudi Arabia National Patent Application No. 523451692 dated Sep. 30, 2024, 7 pages.

(Continued)

*Primary Examiner* — Patrick J. Lynch
(74) *Attorney, Agent, or Firm* — Baker, Donelson, Bearman, Caldwell & Berkowitz, P.C.; Edward D. Lanquist; Dominic A. Rota

(57) ABSTRACT

A medical gown (100) and method of donning are disclosed herein. The medical gown may comprise a top portion (110), a bottom portion (112), a first tie (134), a second tie (136), and a cover patch (120). The top portion may include arms (Continued)

(140) and a neck opening (152). The bottom portion may include a front bottom side (128), a first rear flap (130), a second rear flap (132), and the first tie integrally formed with the first rear flap. The first and second rear flaps may extend from opposite edges of the front bottom side. The cover patch may be configured to at least partially couple the top portion and the bottom portion together. The second tie may be coupled between the cover patch and the bottom portion. The medical gown may provide easy donning and doffing as well as be optimally configured for manufacturing using automation.

15 Claims, 11 Drawing Sheets

(56) References Cited

U.S. PATENT DOCUMENTS

| | | | | |
|---|---|---|---|---|
| 3,720,957 | A | 3/1973 | Patience | |
| 3,801,986 | A * | 4/1974 | Purdon | A41D 1/082 2/69 |
| 4,467,476 | A | 8/1984 | Herbert | |
| 5,062,159 | A * | 11/1991 | Jakub | A41D 13/1236 2/70 |
| 5,097,536 | A * | 3/1992 | Cohen | A41D 13/1245 2/119 |
| 6,115,839 | A * | 9/2000 | Covington | A41D 13/1209 2/114 |
| 11,589,624 | B2 | 2/2023 | Pasko et al. | |
| 2006/0253953 | A1* | 11/2006 | Williams | A41D 13/1272 2/69 |
| 2007/0028344 | A1* | 2/2007 | Czajka | A41D 13/1209 2/51 |
| 2009/0031471 | A1* | 2/2009 | Dague | A41D 13/1245 2/243.1 |
| 2013/0091615 | A1* | 4/2013 | Pasko | A41D 13/12 2/114 |
| 2013/0276201 | A1 | 10/2013 | Pezzimenti | |
| 2013/0276204 | A1 | 10/2013 | Pasko et al. | |
| 2014/0189931 | A1* | 7/2014 | Fredrickson | A41D 27/205 2/114 |
| 2015/0150317 | A1* | 6/2015 | Terrell | A41D 13/1245 2/114 |
| 2015/0296896 | A1* | 10/2015 | Laguna | A41D 13/1245 450/58 |
| 2017/0281431 | A1* | 10/2017 | Louwrens | B65D 83/0805 |
| 2018/0132550 | A1* | 5/2018 | Czajka | A62B 18/045 |
| 2018/0325195 | A1* | 11/2018 | Emoff | A41D 13/1236 |
| 2018/0343940 | A1* | 12/2018 | Genender | A41D 13/1236 |
| 2019/0343198 | A1* | 11/2019 | Palomo | A41D 27/00 |

FOREIGN PATENT DOCUMENTS

| | | | |
|---|---|---|---|
| KR | 10-2223940 | B1 | 3/2021 |
| WO | 9526649 | A1 | 10/1995 |
| WO | PCTUS2022029263 | A1 | 12/2022 |

OTHER PUBLICATIONS

Saudi Authority for Intellectual Property, Notice of Substantive Examination Report (corresponding English translation) issued on Saudi Arabia National Patent Application No. 523451692 dated Sep. 30, 2024, 4 pages.

Korean Intellectual Property Office, Written Opinion of the International Searching Authority issued on corresponding PCT Application No. PCT/US2022/029623 dated Sep. 5, 2022, 5 pages.

Korean Intellectual Property Office, International Search Report issued on corresponding PCT Application No. PCT/US2022/029623 dated Sep. 5, 2022, 3 pages.

Saudi Authority for Intellectual Property, Second Substantive Examination Report (in Arabic) issued on Saudi Arabia National Patent Application No. 523451692 dated Jul. 28, 2025, 8 pages.

Saudi Authority for Intellectual Property, Second Substantive Examination Report (corresponding English translation) issued on Saudi Arabia National Patent Application No. 523451692 dated Jul. 28, 2025, 8 pages.

Japan Patent Office, Notice of Reasons for Rejection (in Japanese) issued on Japanese National Patent Application No. 2023-573104 dated Aug. 28, 2025, 8 pages.

Japan Patent Office, Notice of Reasons for Rejection (corresponding English translation) issued on Japanese National Patent Application No. 2023-573104 dated Aug. 28, 2025, 8 pages.

Turkish Patent and Trademark Office, Notice of Examination Report (in Turkish) issued on Turkish Application No. 2023/015819 dated Sep. 2, 2025, 4 pages.

* cited by examiner

MEDICAL GOWN AND METHOD OF DONNING THE SAME

CROSS-REFERENCE TO RELATED APPLICATIONS

This application is a § 371 national stage entry of PCT/US2022/029623 filed May 17, 2022, which claims priority to U.S. Provisional Patent Application No. 63/194,079 entitled "MEDICAL GOWN AND METHOD OF DONNING THE SAME," filed May 27, 2021, both which are hereby incorporated by reference in their entireties.

TECHNICAL FIELD

The present invention relates generally to medical gowns. More particularly, this invention pertains to multi-piece closed-back/tube-style medical gowns.

BACKGROUND ART

Medical gowns are commonly used in hospitals, clinics and other diagnostic facilities. Medical gowns are worn by both users and health care providers during medical procedures. Medical gowns serve a protective function by helping to prevent the transmission of germs and microbes. For example, hospital staff, patients, and visitors may wear isolation garments to avoid exposure to blood, other body fluids, and infectious materials or to protect patients, especially those with weakened immune systems, from infection.

One issue with prior art medical gowns is that they are time-consuming to put on and take off. Additionally, where the gown is sterile, it is difficult to don a gown without compromising the gown's exterior sterility. Removing a medical gown can also be difficult and may compromise the protective function thereof by transmitting germs to the user while removing the gown. It would be advantageous to have an improved medical gown.

DISCLOSURE OF THE INVENTION

The present disclosure provides a disposable medical gown that can easily be donned and doffed. The disposable medical gown comprises a two-piece construction having an upper section and a lower section glued together to define an overlap of multiple layers. The disposable medical gown includes a slit in back (e.g., defined between first and second rear flaps) that terminates at the overlap of multiple layers that are glued together, an outermost layer thereof being a cover patch. The cover patch is glued to the overlapping layers and is further used to reinforce the connection between the back portion and the first and second ties. The disposable medical gown further includes finger slits as opposed to finger holes at the end of the sleeves. The disposable medical gown is amenable to construction using a high-speed process due to the separate upper and lower sections in combination with the cover patch.

In a particular embodiment, an exemplary medical gown as disclosed herein may include a top portion, a bottom portion, a first tie, a second tie, and a cover patch. The top portion may include arms and a neck opening. The bottom portion may include a front bottom side, a first rear flap, a second rear flap, and the first tie integrally formed with the first rear flap. The first and second rear flaps may extend from opposite edges of the front bottom side. The cover patch may be configured to at least partially couple the top portion and the bottom portion together. The second tie may be coupled between the cover patch and the bottom portion.

In an exemplary aspect according to the above-referenced embodiment, a front side of the top portion may at least partially overlap and may further be coupled to the front bottom side of the bottom portion.

In another exemplary aspect according to the above-referenced embodiment, the first tie may be defined by a cut in the first rear flap.

In another exemplary aspect according to the above-referenced embodiment, the cut in the first rear flap may be offset from a bottom edge of the bottom portion.

In another exemplary aspect according to the above-referenced embodiment, the cut in the first rear flap may be offset from the cover patch.

In another exemplary aspect according to the above-referenced embodiment, the cut may comprise a crush cut.

In another exemplary aspect according to the above-referenced embodiment, the cover patch may be positioned along a rear side of the top portion and the first and second rear flaps of the bottom portion.

In another exemplary aspect according to the above-referenced embodiment, the cover patch may be coupled to a bottom edge of the top portion and top flap edges of the first and second rear flaps of the bottom portion.

In another exemplary aspect according to the above-referenced embodiment, the second tie may be coupled between the cover patch and the second rear flap. In accordance with this embodiment, the second tie may further be coupled to the bottom portion proximate to a bottom edge of the bottom portion.

In another exemplary aspect according to the above-referenced embodiment, the top portion may include a weakened portion extending downward from the neck opening along a rear side of the top portion In another exemplary aspect according to the above-referenced embodiment, the weakened portion may include a V-shaped portion extending downward from the neck opening and a straight portion extending downward from the V-shaped portion.

In another exemplary aspect according to the above-referenced embodiment, the cover patch may include a weakened portion aligned with the weakened portion of the top portion.

In another exemplary aspect according to the above-referenced embodiment, the weakened portion may be defined by perforations comprising a plurality of slits separated by a plurality of material bridges.

In another exemplary aspect according to the above-referenced embodiment, each of the plurality of slits may include a slit length of about 0.9 inch and each of the plurality of material bridges may include a bridge length of about 0.2 inch.

In another exemplary aspect according to the above-referenced embodiment, the top portion may comprise a singular piece of material folded in half along an upper fold line to define the arms.

In another exemplary aspect according to the above-referenced embodiment, the arms may include a thumb slit defined along a front side of the upper portion, each thumb slit being about 3 inches.

In another embodiment, an exemplary embodiment of a method of donning the medical gown is disclosed herein. The method may comprise (a) separating lower portions of first and second ties of the medical gown, the first tie integrally formed with a first rear flap and centrally located along a rear side of the medical gown, the second tie coupled to the rear side of the medical gown proximate a first folded edge defined between a front side and the rear side of the medical gown; and (b) wrapping the first and second ties around the user.

In an exemplary aspect according to the above-referenced embodiment, step (a) of the method may further comprise positioning the medical gown on the user such that the medical gown at least partially covers the user.

In another exemplary aspect according to the above-referenced embodiment, the method may further comprise tying the first and second ties together along the front side of the medical gown.

In another exemplary aspect according to the above-referenced embodiment, the method may further comprise inserting the users thumbs through thumb slits defined along arms of the medical gown.

In another exemplary aspect according to the above-referenced embodiment, following step (a), only upper ends of the first and second ties may be coupled to the medical gown.

BEST MODE FOR CARRYING OUT THE INVENTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

Figure 1:
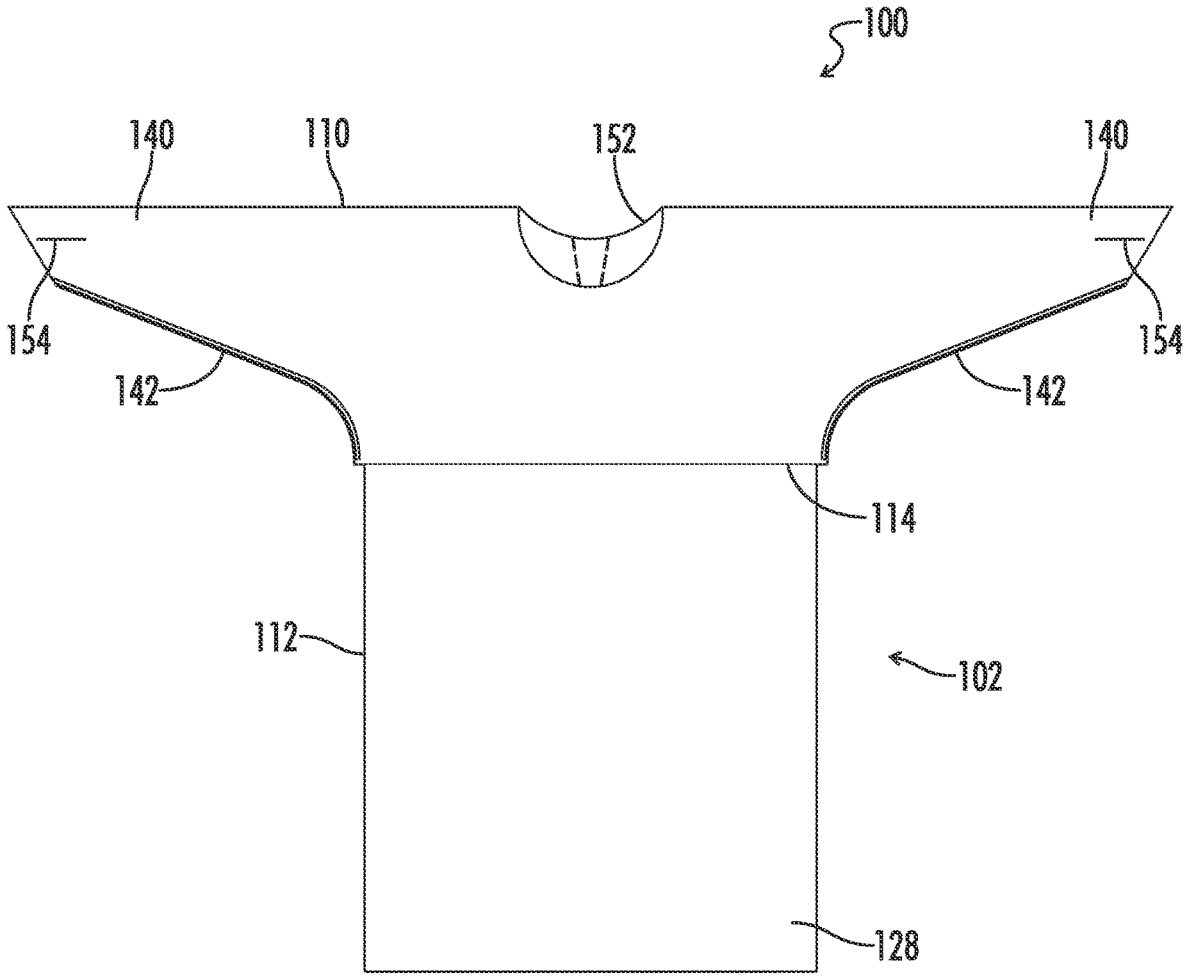
FIG. 1 is a front elevation view of a medical gown in accordance with the present disclosure.
Figure 2:
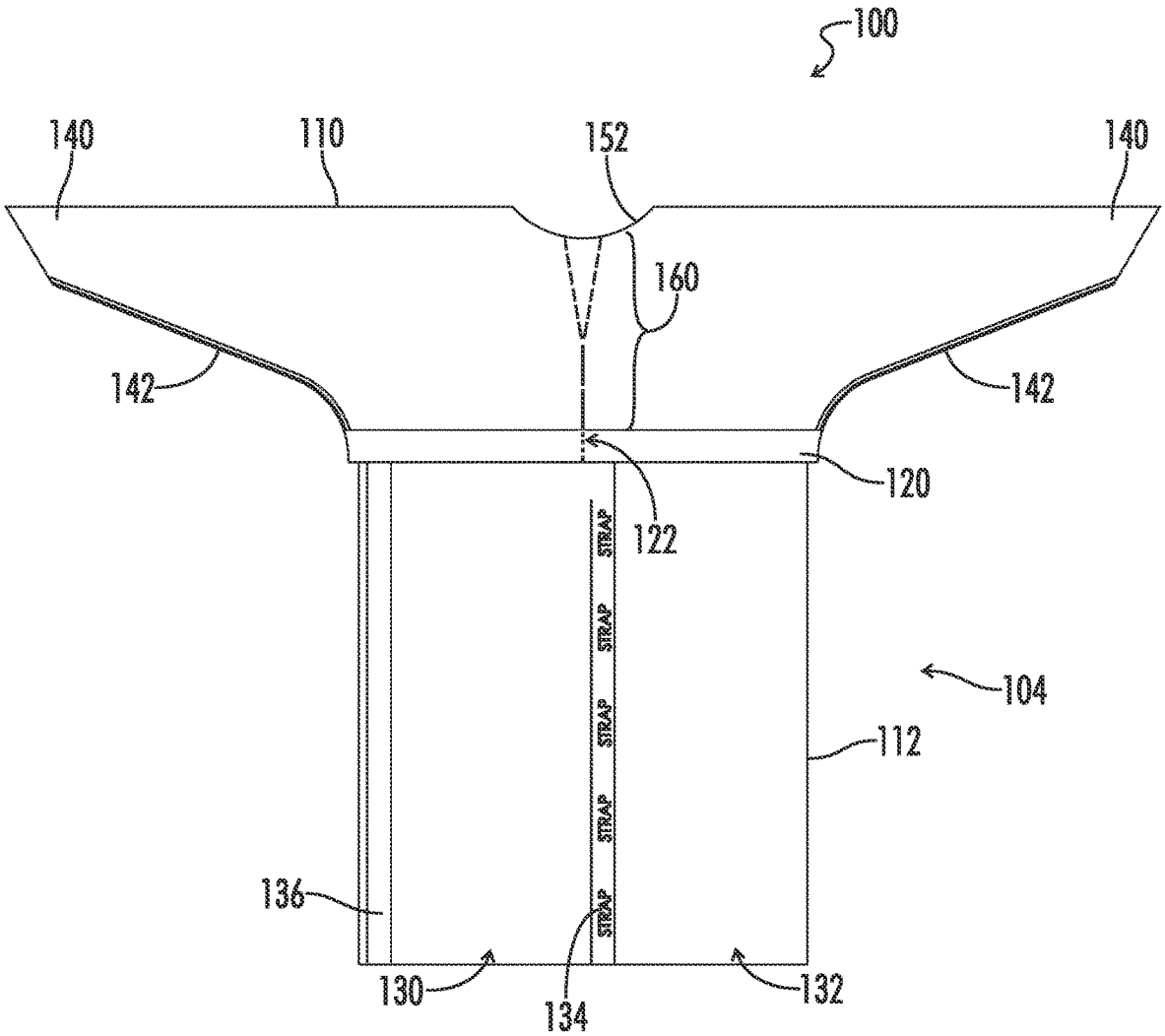
FIG. 2 is a rear elevational view of the medical gown of FIG. 1 in accordance with the present disclosure.
Figure 3:
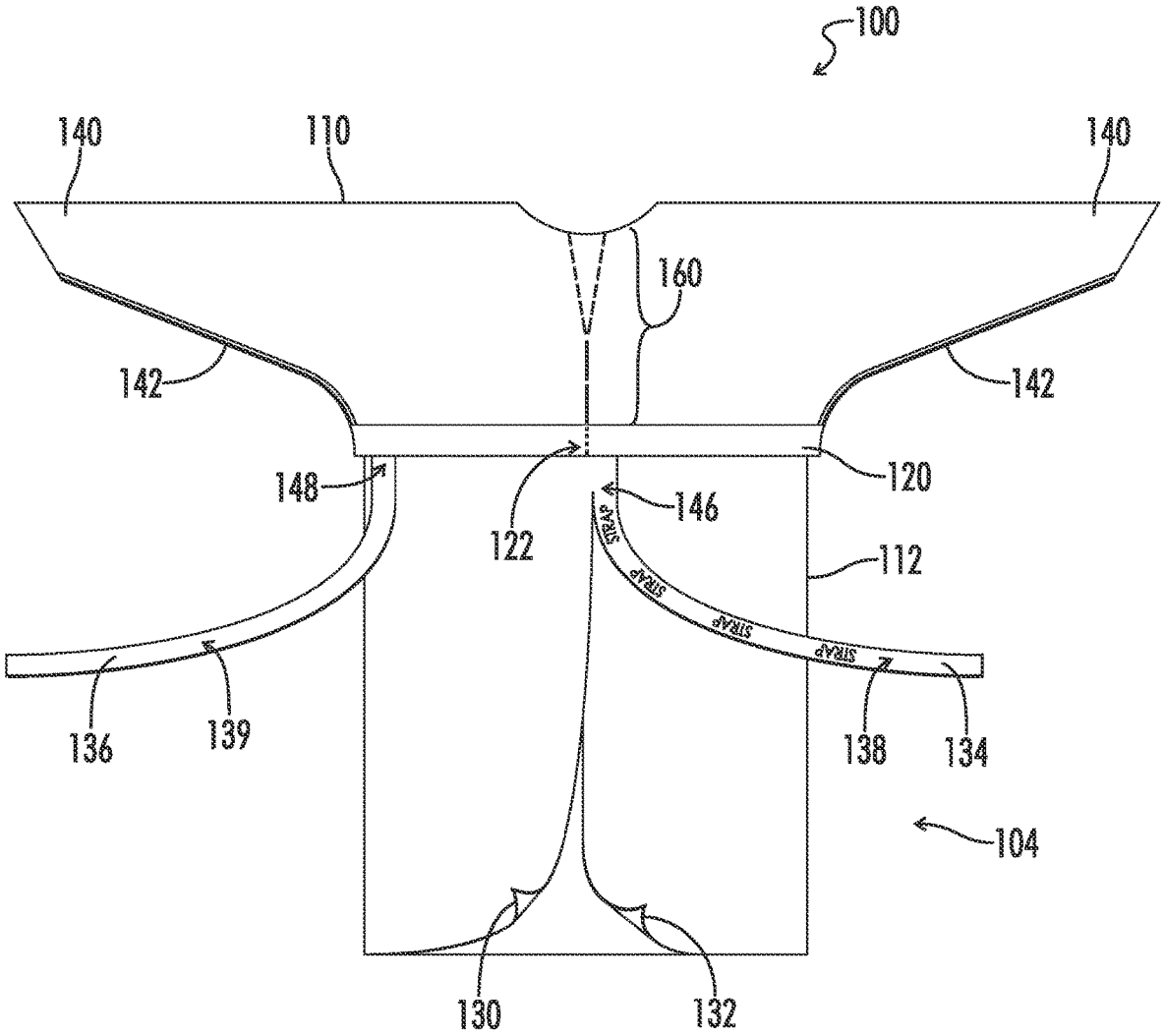
FIG. 3 is a rear elevational view of the medical gown of FIG. 1 with first and second rear flaps in a lifted state as well as first and second ties in a lifted state in accordance with the present disclosure.

Referring to FIGS. 1-3, a medical gown 100 is shown. The medical gown 100 may also be referred to herein as a disposable medical gown 100, an isolation gown 100, or a gown 100. The medical gown 100 is configured such that it can be easily donned and doffed. The medical gown 100 includes a top portion 110 and a bottom portion 112. The top portion 110 and the bottom portion 112 may be separate pieces coupled together. In other optional embodiments, the top portion 110 and the bottom portion 112 may be integrally formed. The top portion 110 may also be referred to herein as a top piece 110. The bottom portion 112 may also be referred to herein as a bottom piece 112.

Figure 4:
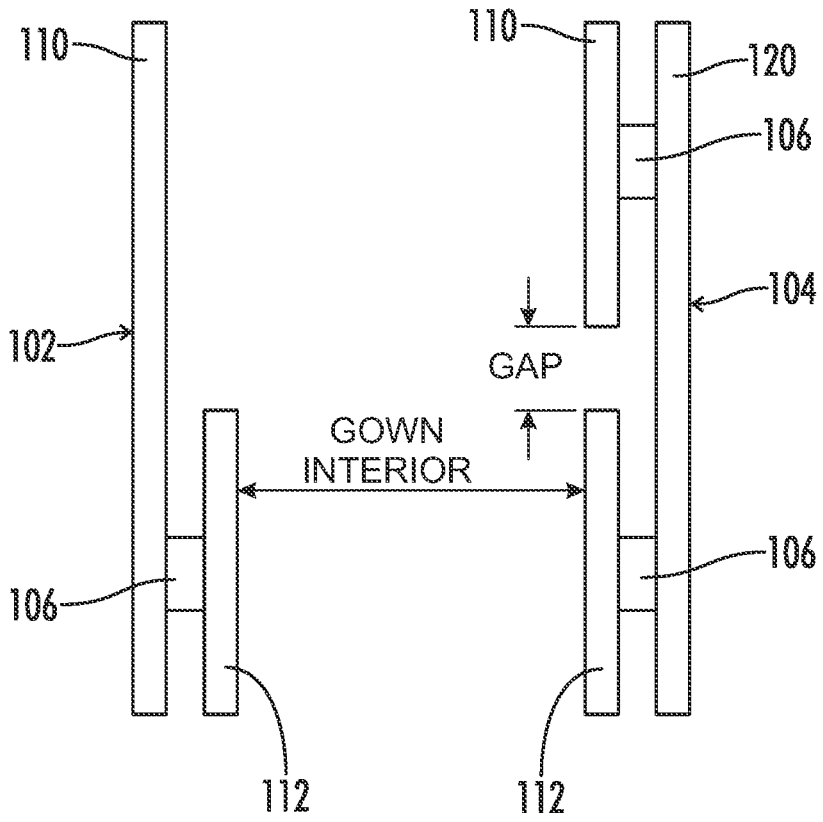
FIG. 4 is an enlarged cross-sectional view of the medical gown of FIG. 1 in accordance with the present disclosure.

As shown in FIG. 4, the top portion 110 may overlap the bottom portion 112 along a front side 102 of the medical gown 100 and may be glued together using an adhesive. As shown in FIGS. 2-4, the top portion 110 and the bottom portion 112 along a rear side 104 of the medical gown 100 may be coupled together using a cover patch 120 of the medical gown 100. For example, the cover patch 120 may be coupled to a bottom edge 114 of the top portion 110 and the top edge 172 of the bottom portion 112 along the rear side 104 and corresponding to the first and second rear flaps 130, 132. The top portion 110 and the bottom portion 112 may be gapped apart along the rear side 104 of the medical gown 100. In other optional embodiments, the top portion 110 and the bottom portion 112 may overlap along a rear side 104 of the medical gown 100. The cover patch 120 may be glued to each of the top portion 110 and the bottom portion 112 along the rear side 104 of the medical gown 100 using an adhesive 106. The adhesive may be a hot melt type adhesive or similar adhesive that is operatively configured to be compatible with the high-speed automated process of constructing the medical gown 100.

As shown in FIGS. 2-3, the bottom portion 112 of the medical gown 100 may include a front bottom side 128, a first rear flap 130 and a second rear flap 132 extending from opposite edges of the front bottom side 128, as well as a first tie 134 integrally formed as part of the first rear flap 130, near the center of the rear side 104 of the medical gown 100. The medical gown 100 may further include a second tie 136 coupled to the first rear flap 130 nearer to a left folded edge 131 of the bottom portion 112 of the medical gown 100 than to a right folded edge 133 of the bottom portion 112 of the medical gown 100. The left folded edge 131 may also be referred to herein as a first folded edge 131 or a first edge 131. The right folded edge 133 may also be referred to herein as a second folded edge 133 or a second edge 133. In certain optional embodiments (not shown), the first tie 134 may be integrally formed as part of the second rear flap 132 with the second tie 136 coupled to the second rear flap 132 proximate to the right folded edge of the bottom portion 112.

Figure 5:
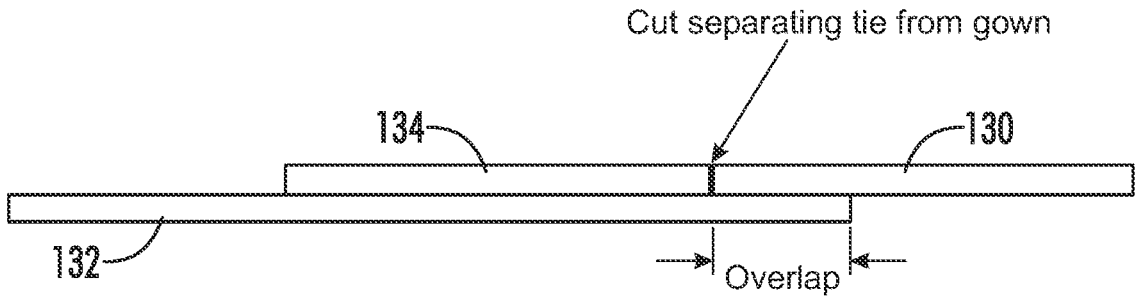
FIG. 5 is an enlarged cross-sectional view of the medical gown of FIG. 1 in accordance with the present disclosure.

As shown in FIGS. 3 and 5, the first rear flap 130 and the second rear flap 132 may be configured to overlap, regardless of the integrally formed first tie 134. The second tie 136 may be secured to the medical gown 100 using the cover patch 120 and the adhesive coupling it to the rear side 104 of the medical gown 100. The connection of the first and second ties 134, 136 to the rear side 104 of the medical gown 100 may be reinforced using the cover patch 120.

In certain optional embodiments, the top portion 110 where it overlaps and couples to the bottom portion 112 may be wider than the bottom portion 112. In such embodiments, the cover patch 120 may extend beyond the edges of the bottom portion 112 and adhesively couple to the upper portion 110 (e.g., a rear side of a front portion of the upper portion 110 of the medical gown 100). As such, the multiple layers overlapping portions, and gapped portions of the medical gown 100 are hidden and sealed using the cover patch 120.

The arms 140 of the medical gown 100 may be formed by coupled seams 142 to bind the two layers together. The coupled seams 142 may be accomplished using sonic welding, heat welding, adhesive, or the like which is compatible with a high-speed automated process of constructing the medical gown 100.

Figure 6:
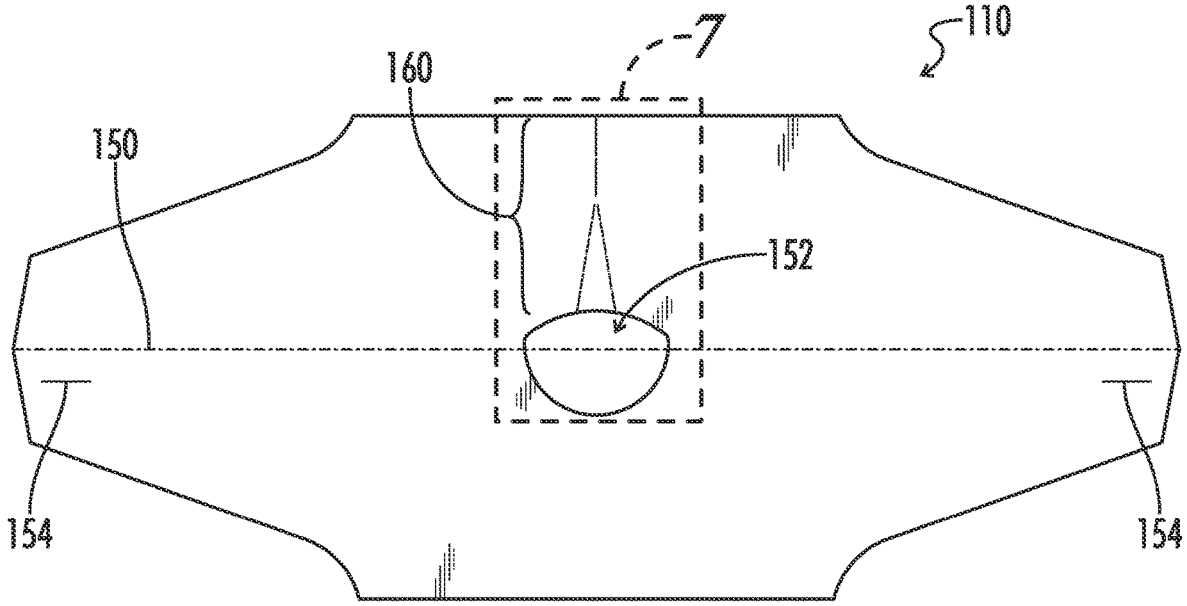
FIG. 6 is a top plan view of a top portion of the medical gown of FIG. 1 in accordance with the present disclosure.
Figure 7:
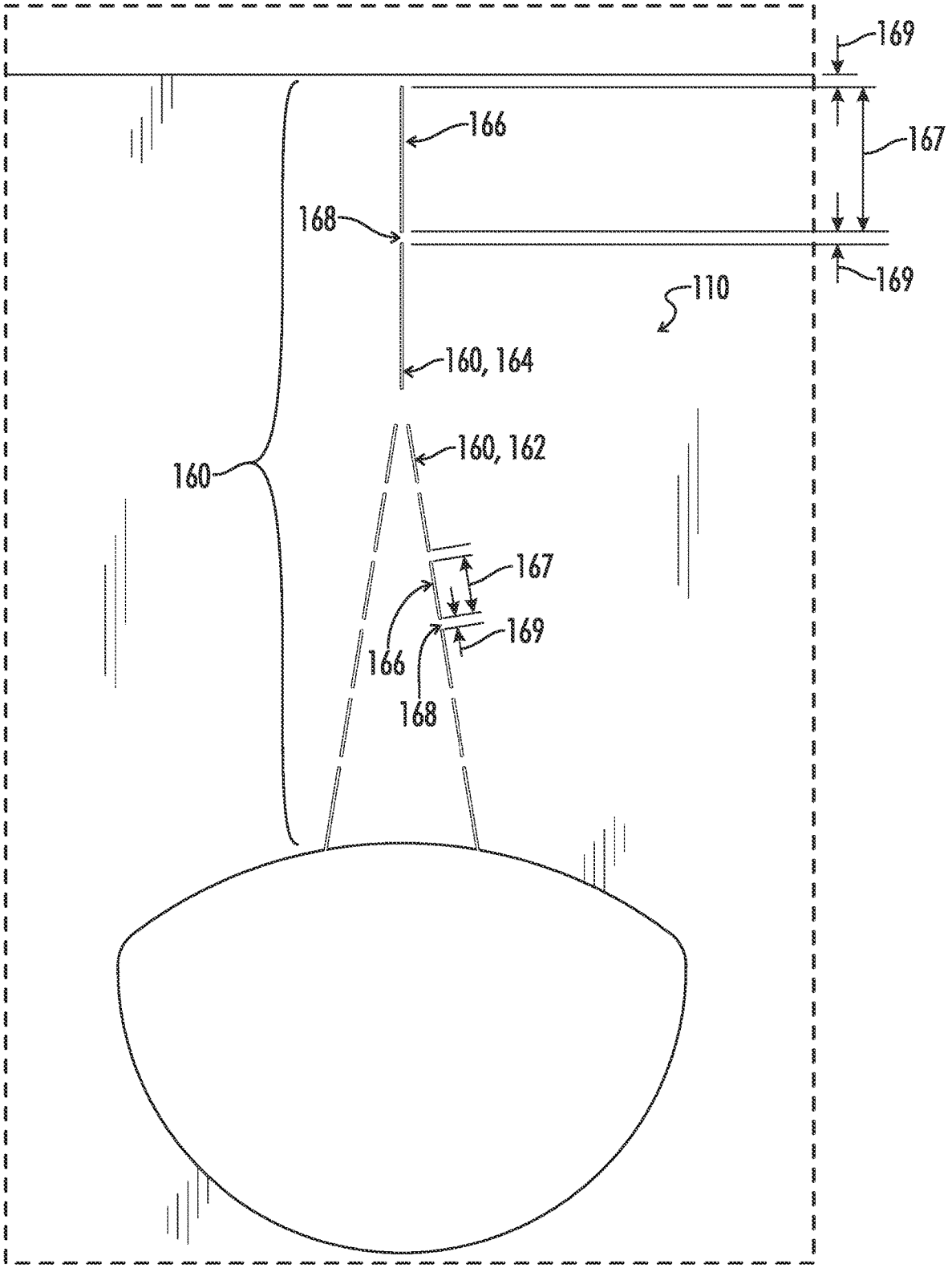
FIG. 7 is an enlarged view of a dashed area 7 in FIG. 6 of the top portion of the medical gown of FIG. 6 in accordance with the present disclosure.

Referring to FIGS. 6-7, detailed views of the top portion 110 of the medical gown 100 are shown. The top portion 110 comprises a singular piece of material that is folded along the upper fold line 150 to define the arms 140. The top portion 110 further includes a neck opening 152 defined therein and bisected by the upper fold line 150. Each of the arms 140 of the top portion 110 may include a thumb slit 154. The thumb slits 154 are beneficial for helping a user's arms stay covered when wearing the gown with gloves on. The thumb slits 154 may be about 3 inches. In other optional embodiments, the thumb slits 154 may be larger or smaller than 3 inches depending on a size of the medical gown 100 (e.g., small, medium, large, etc.). In certain optional embodiments, the cover patch 120 may be cut from the top portion 110 during construction of the medical gown 100.

As shown in FIGS. 2 and 3, the top portion 110 of the medical gown 100 may include a weakened portion 160 extending downward from the neck opening 152 along the rear side 104 of the medical gown 100. The weakened portion 160 may extend between the neck opening 152 and an opening between the first and second rear flaps 130, 132. As illustrated in FIG. 7, the weakened portion 160 may include a V-shaped portion 162 extending downward from the neck opening 152 and a straight portion 164 extending downward from the V-shaped portion 162.

The weakened portion 160 may be defined by perforations comprising a plurality of slits 166 alternatingly separated by a plurality of material bridges 168. As shown in FIG. 7, each of the plurality of slits 166 may include a slit length 167 and each of the plurality of material bridges 168 may include a bridge length 169. In one optional embodiment, the slit length 167 of the V-shaped portion 162 may be about 0.9 inch and the bridge length 169 may be 0.2 inch. In another optional embodiment, the slit length 167 of the straight portion 164 may be about 2.29 inch and the bridge length 169 may be 0.2 inch. In a further optional embodiment, the slit length 167 of the weakened portion 122 of the cover patch 120 may be about 0.39 inch and the bridge length 169 may be 0.12 inch. In other optional embodiments, the slit length 167 and the bridge length 169 may be different.

Figure 8:
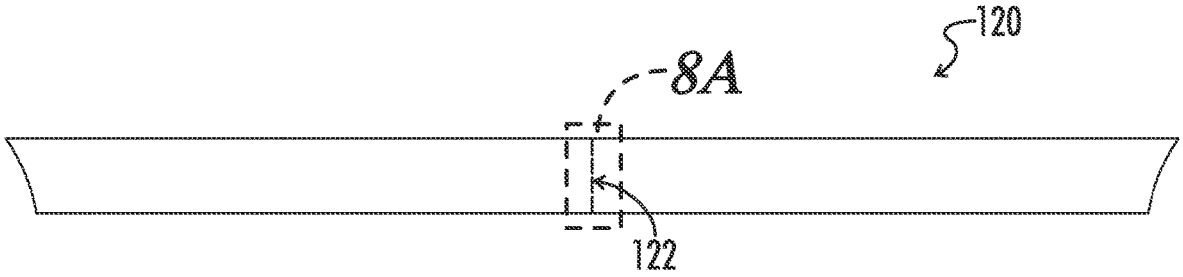
FIG. 8 is a front elevation view of a cover patch of the medical gown of FIG. 2 in accordance with the present disclosure.
Figure 8A:
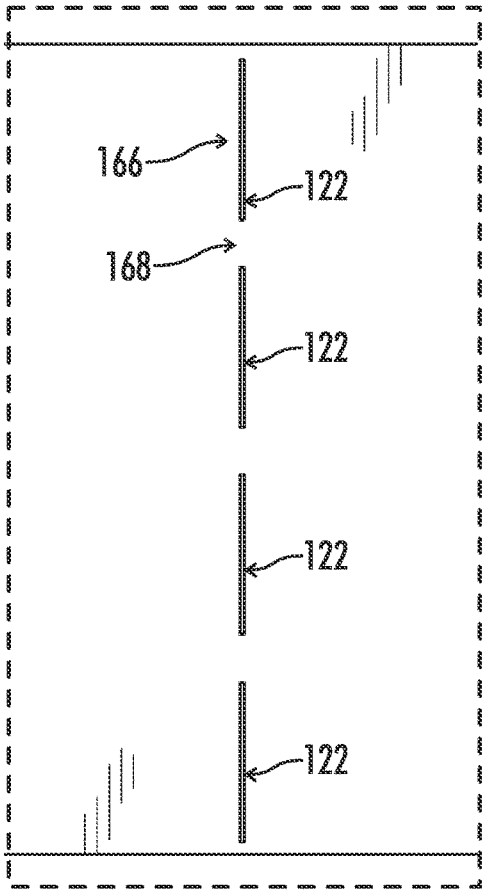
FIG. 8A is an enlarged view of dashed area 8A in FIG. 8 of the cover patch of the medical gown of FIG. 8 in accordance with the present disclosure.

Similarly, as illustrated in FIGS. 8 and 8A, the cover patch 120 includes a weakened portion 122. The weakened portion 122 of the cover patch is configured to align with the straight portion 164 of the weakened portion 160 of the top portion 110 of the medical gown 100. The weakened portion 122 may be similar to the weakened portion 160. As such, similar features of the weakened portion 122 may be labeled similar to those of the weakened portion 160.

The weakened portions 160, 122 of the upper portion 110 and the cover patch 120, respectively, enable the medical gown 100 to be doffed (e.g., removed) by pulling the medical gown 100 forward away from the user's body, such that the medical gown 100 rips along the weakened portions 160, 122.

The weakened portions 160, 122 of the top portion 110 and the cover patch 120, respectively, may be formed as traditional perforations, which are cuts through the material, or some other process of weaking the material.

Figure 9:
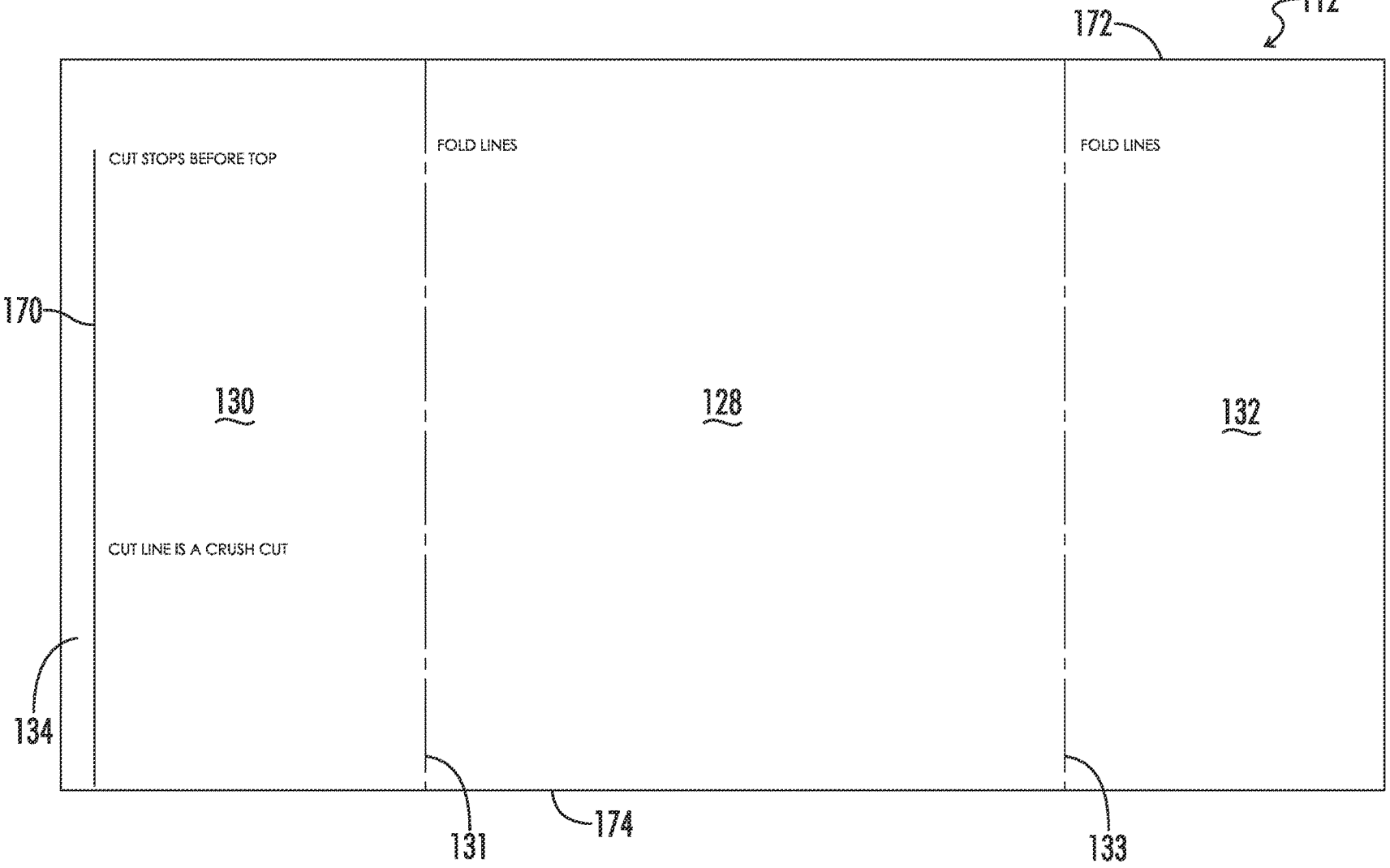
FIG. 9 is a rear elevation view of a bottom portion of the medical gown of FIG. 1 in an unfolded configuration in accordance with the present disclosure.
Figure 10:
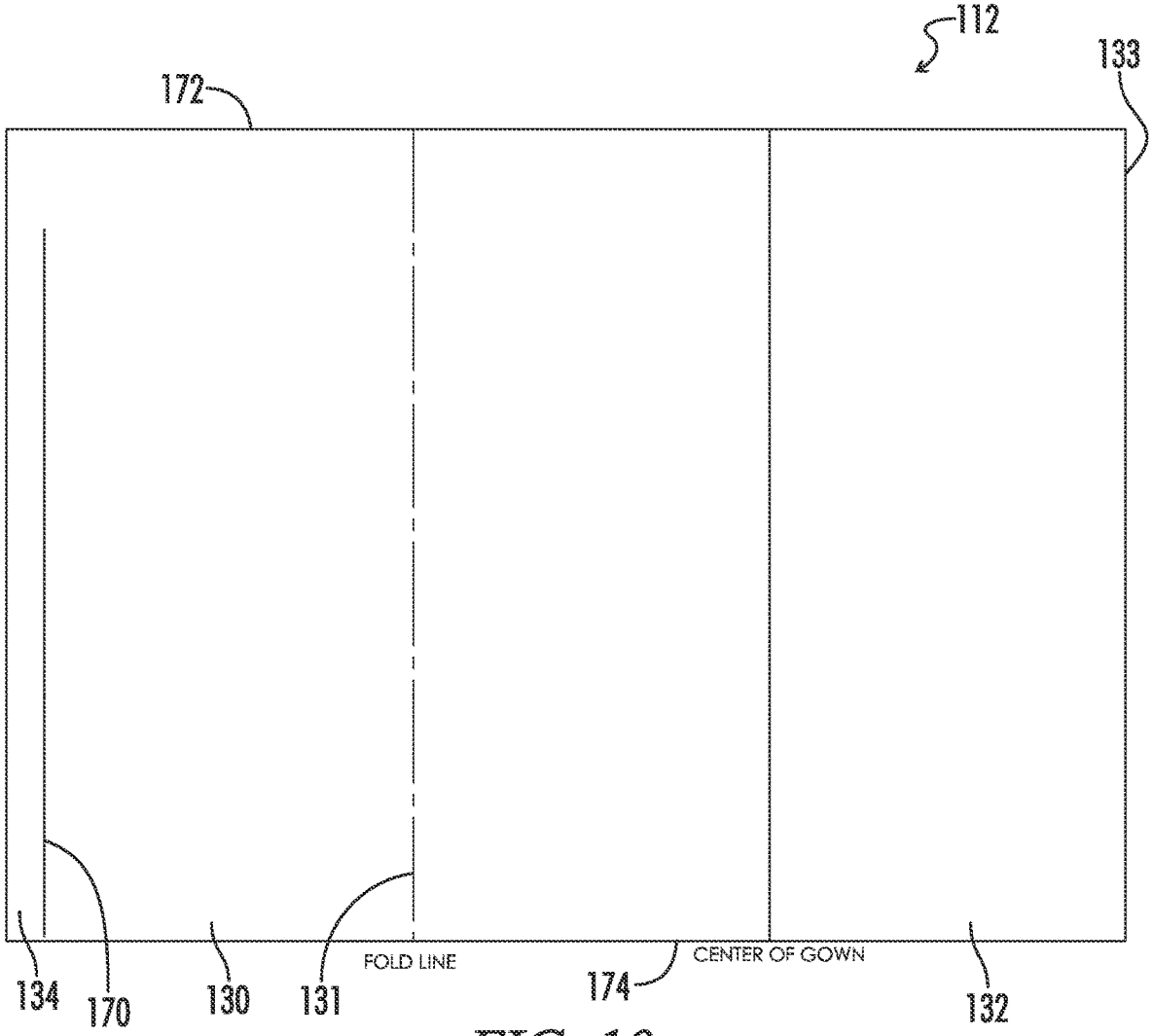
FIG. 10 is a rear elevation view of the bottom portion of the medical gown of FIG. 9 in a partially folded configuration in accordance with the present disclosure.
Figure 11:
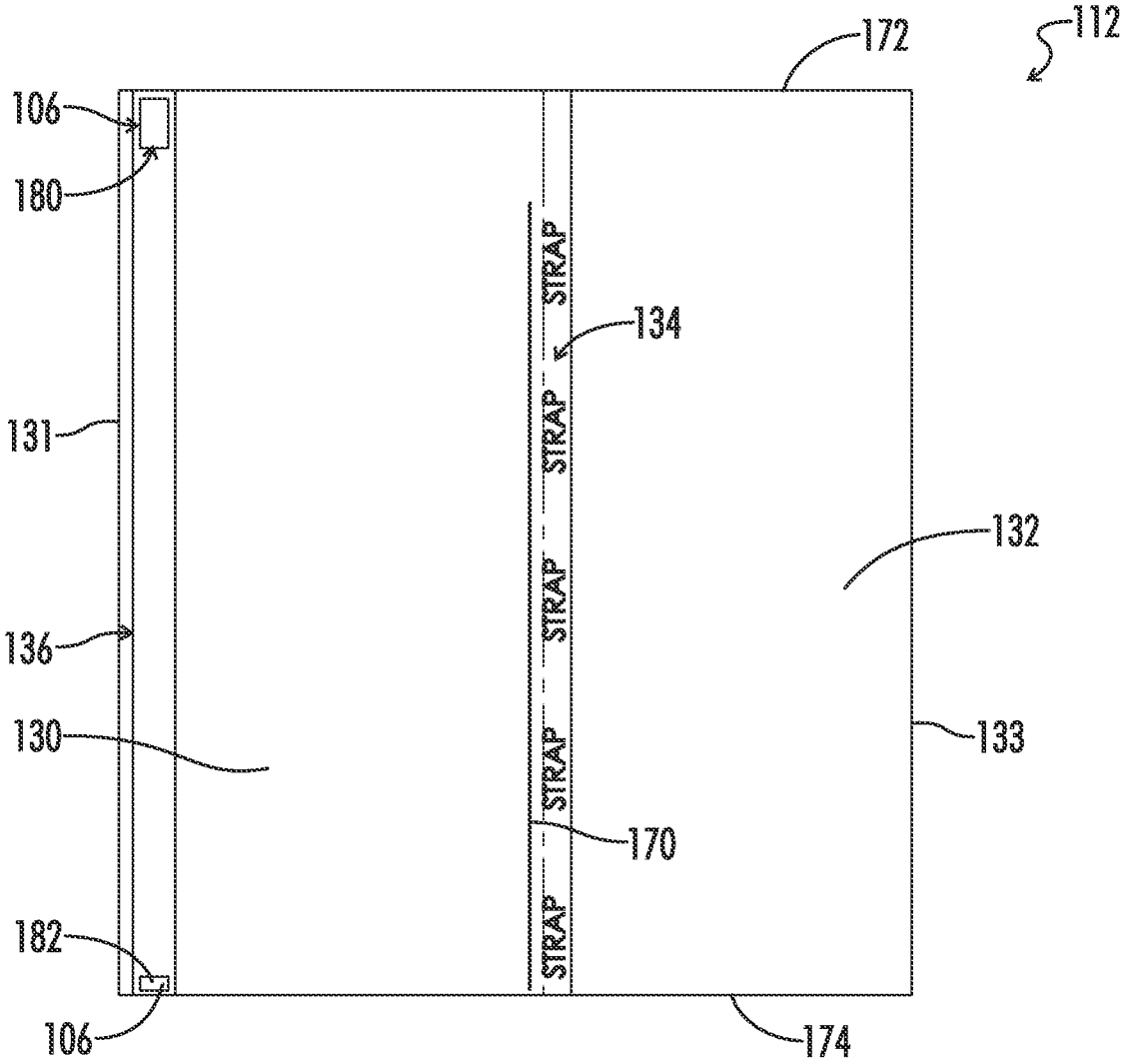
FIG. 11 is a rear elevation view of the bottom portion of the medical gown of FIG. 9 in a folded configuration in accordance with the present disclosure.

Referring to FIGS. 9-11, detailed views of the bottom portion 112 of the medical gown 100 are shown. FIG. 9 illustrates an unfolded view of the bottom portion 112. FIG. 10 illustrates a partially folded view of the bottom portion 112. FIG. 11 illustrates a folded view of the bottom portion 112. The bottom portion 112 is folded in two locations to form the first and second rear flaps 130, 132. As illustrated in FIG. 9, the second tie 136 may be cut from the bottom portion 112 during construction of the medical gown 100.

The first tie 134 is integrally formed from the bottom portion 112 by cutting the bottom portion 112 in specific locations to leave the first tie 134 connected thereto. The cut 170 may be a crush cut. For example, the cut 170 that defines the first tie 134 terminates prior to a top edge 172 of the bottom portion 112 and is offset from the cover patch 120. The cut 170 that defines the first tie 134 further terminates prior to a bottom edge 174 of the bottom portion 112. The first tie 134 is coupled to the bottom portion 112 at the top and bottom in order to keep it in place while the gown is constructed and folded using the high-speed automated process of constructing the medical gown 100. The first tie 134 is configured to be ripped away from the bottom edge 174 of the medical gown 100 prior to or once the medical gown 100 is donned such that the first tie 134 can be used in conjunction with the second tie 136 for tightening the medical gown 100 around a waist of the user.

As shown in FIG. 11, the second tie 136 may be coupled to the bottom portion 112 of the medical gown 100 using an adhesive applied at an upper portion 180 of the second tie 136 as well as at a lower portion 182 of the second tie 136. The upper portion 180 of the second tie 136 may be coupled to the bottom portion 112 of the medical gown 100 closer to the top edge 172 than to the bottom edge 174. The lower portion 182 of the second tie 136 may be coupled to the bottom portion 112 of the medical gown 100 closer to the bottom edge 174 than to the top edge 172 (e.g., proximate to the bottom edge 174). The adhesive applied at the lower portion 182 may be weak enough such that the lower portion 182 of the second tie 136 can easily be ripped away from the bottom portion 112 of the medical gown 100 prior to or once the medical gown 100 is donned such that the second tie 136 can be used conjunction with the first tie 134 for tightening the medical gown 100 around a waist or torso of the user.

The connections between the first tie 134 and the bottom portion 112 of the medical gown 100, as well as the connections between the second tie 136 and the bottom portion 112 of the medical gown 100 are reinforced by the cover patch 120 once the medical gown 100 has been constructed using the high-speed automated process of constructing the medical gown 100.

The medical gown 100 is operatively configured to be constructed using a high-speed automated process which may construct, fold, and package the medical gown 100. The various elements of the medical gown 100, namely, the separate upper portion 110, lower portion 112, and cover patch 120, make it especially amenable to construction using a high-speed automated process. Further for example, the first tie 134 may be integrally formed from the bottom portion 112, the second tie 136 may be fashioned (e.g., cut) from the bottom portion 112, and both ties 134, 136 may be coupled at tops and bottoms, respectively, to the bottom portion 112 to help make the medical gown 100 well suited for construction using a high-speed automated process and folding prior to packaging.

The high-speed automated process may include constructing each of the top and bottom portions 110, 112 separately. The high-speed automated process may continue by coupling the top and bottom portions 110, 112 together and applying the cover patch 120. The high-speed automated process may further include folding and packaging the completed or assembled medical gown 100 such that its sterility is not compromised.

Figure 12:
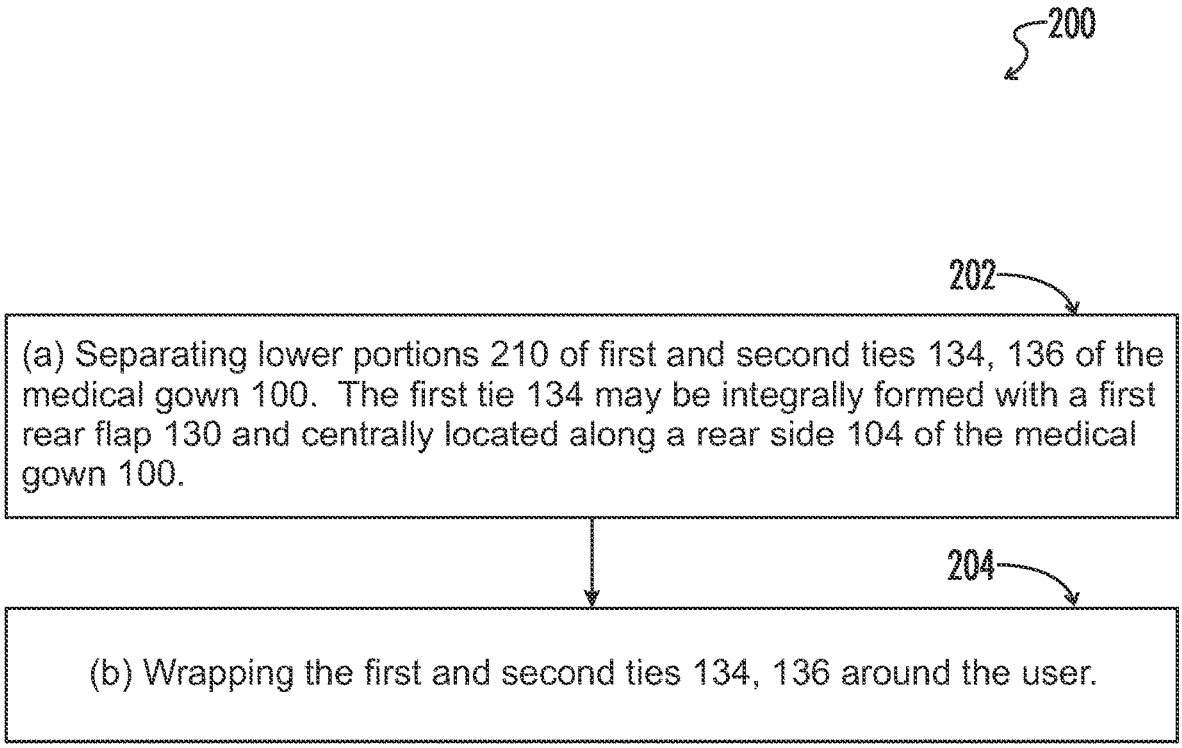
FIG. 12 is a flow chart of a method of donning the medical gown of FIG. 1 in accordance with the present disclosure.

Referring to FIG. 12, a flow chart of a method 200 of donning the medical gown 100 is shown. The medical gown 100 may be configured to be positioned at least partially on a user (not shown). The method 200 may comprise (a) separating 202 lower portions 210 of first and second ties 134, 136 of the medical gown 100. The first tie 134 may be integrally formed with a first rear flap 130 and centrally located along a rear side 104 of the medical gown 100. The second tie 136 may be coupled to the rear side 104 of the medical gown 100 proximate the first folded edge 131 defined between a front side 102 and the rear side 104 of the medical gown 100. The method 200 may further comprise (b) wrapping 204 the first and second ties 134, 136 around the user.

In certain optional embodiments, step (a) of the method 200 may further include positioning the medical gown 100 on the user such that the medical gown 100 at least partially covers the user. In other optional embodiments, the method 200 may further comprise tying the first and second ties 134, 136 together along the front side 102 of the medical gown 100. In further optional embodiments, the method 200 may further comprise inserting the users thumbs through the thumb slits 154 defined along the arms 140 of the medical gown 100. Following step (a) only the upper ends 146, 148 of the first and second ties 134, 136 are coupled to the medical gown 100.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The previous detailed description has been provided for the purposes of illustration and description. Thus, although there have been described particular embodiments of a new and useful invention, it is not intended that such references be construed as limitations upon the scope of this disclosure except as set forth in the following claims.

What is claimed is:

1. A medical gown having a front side and a rear side, the medical grown comprising:

a top portion including arms and a neck opening;

a bottom portion including a front bottom side on the front side of the medical gown, a first rear flap on the rear side of the medical gown, a second rear flap on the rear side of the medical gown, and a first tie integrally formed with the first rear flap, the first rear flap and the second rear flap extending from opposite edges of the front bottom side;

a cover patch coupling a bottom edge of the top portion to a top edge of the bottom portion together on the rear side of the medical gown and securing a second tie to the rear side of the medical gown, wherein the second tie is coupled between the cover patch and the bottom portion.

2. The medical gown of claim 1, wherein:

at least a portion of the top portion overlaps and is coupled to the front bottom side along the front side of the medical gown.

3. The medical gown of claim 1, wherein:

the first tie is defined by a cut in the first rear flap.

4. The medical gown of claim 3, wherein:

the cut in the first rear flap is offset from a bottom edge of the bottom portion.

5. The medical gown of claim 3, wherein:

the cut in the first rear flap is offset from the cover patch.

6. The medical gown of claim 3, wherein:

the cut comprises a crush cut.

7. The medical gown of claim 1, wherein:

the cover patch is positioned across the top portion and the first and second rear flaps of the bottom portion along the rear side of the medical gown.

8. The medical gown of claim 1, wherein:

the cover patch is coupled to the bottom edge of the top portion and the top edge of the bottom portion corresponding to the first rear flap and the second rear flap.

9. The medical gown of claim 1, wherein:

the second tie is coupled between the cover patch and the first rear flap; and the second tie is further coupled to the bottom portion proximate to a bottom edge of the bottom portion.

10. The medical gown of claim 1, wherein:

the top portion includes a weakened portion extending downward from the neck opening on the top portion along the rear side of the medical gown.

11. The medical gown of claim 10, wherein:

the weakened portion includes a V-shaped portion extending downward from the neck opening and a straight portion extending downward from the V-shaped portion.

12. The medical gown of claim 10, wherein:

the cover patch includes a weakened portion aligned with the weakened portion of the top portion.

13. The medical gown of claim 10, wherein:

the weakened portion is defined by perforations comprising a plurality of slits alternatingly separated by a plurality of material bridges.

14. The medical gown of claim 13, wherein:

each of the plurality of slits includes a slit length of about 0.9 inch; and each of the plurality of material bridges includes a bridge length of about 0.2 inch.

15. The medical gown of claim 1, wherein:

the top portion comprises a singular piece of material folded in half along an upper fold line to define the arms.

* * * * *